United States Patent [19]

Baunach

[11] Patent Number: 4,857,910

[45] Date of Patent: Aug. 15, 1989

[54] BIT-MAP CRT DISPLAY CONTROL

[75] Inventor: Stephen C. Baunach, San Jose, Calif.

[73] Assignee: Pitney Bowes Inc., Stamford, Conn.

[21] Appl. No.: 562,789

[22] Filed: Dec. 19, 1983

[51] Int. Cl.[4] ..... G09G 1/16

[52] U.S. Cl. ..... 340/799; 340/798; 340/724

[58] Field of Search ..... 340/723, 724, 748, 750, 340/798, 799, 747

[56] References Cited

U.S. PATENT DOCUMENTS

| | | | |
|---|---|---|---|
| 4,249,172 | 2/1981 | Watkins et al. | 340/750 |
| 4,368,466 | 1/1983 | Dwire | 340/799 |
| 4,414,645 | 11/1983 | Ryan et al. | 340/750 |
| 4,556,879 | 12/1985 | Tanaka | 340/799 |

*Primary Examiner*—Gerald Brigance

*Attorney, Agent, or Firm*—Robert H. Whisker; Melvin J. Scolnick; David E. Pitchenik

[57] ABSTRACT

An apparatus and method for controlling a bit-mapped CRT raster display where a processor stores a bit-map of a CRT display frame in a buffer memory as strings of data words representative of bit-maps for single scan lines of the display. Associated with each string is a pointer which contains the starting address of the string which maps the next scan line. A controller accesses the buffer memory to output the data words of each string to a serializer in synchronism with the raster to generate a CRT video signal. After each string the controller accesses the buffer memory to get the pointer to the next string. In response to a initialization signal from the processor the controller obtains the pointer to the string associated with the first scan line from predetermined locations in memory. Alternatively the processor may directly load the controller with the initial pointer prior to each raster frame. The processor may share the buffer memory with the controller on a cycle-stealing basis to construct new strings. The processor may then easily modify the display by linking and unlinking old and new strings by simple modifications of pointers during the time between raster frames.

30 Claims, 9 Drawing Sheets

BIT-MAP CRT DISPLAY CONTROL

BACKGROUND OF THE INVENTION

This invention relates to a method and apparatus for controlling a CRT display. More particularly, this invention relates to a method and apparatus for controlling a bit-mapped raster type CRT display.

CRT's have long been known as a useful output device for the display of information where a permanent record was not necessary. They provide a high speed, quiet and inexpensive output device for displaying information to an operator. Hertofore, two types of CRT display have been used; a vector, or X-Y plot, display and a raster display. The vector display is useful for the display of graphic information. In a vector display vectors, or directed line segments, are drawn between any two arbitrary points on the CRT display screen. Such line segments are typically straight but may in more advanced systems be curved line segments. Such vector displays are useful for the display of graphic or pictorial information. The other type of display which heretofore has been commonly used is a raster type display wherein the CRT traces out a raster consisting of a sequential set of essentially horizontal scan lines, typically beginning at the top left hand corner and tracing lines from left to right and top to bottom. After completing the full set of lines, commonly referred to as a frame, the CRT returns to the top left hand corner to begin a new frame. As the beam traces out each frame the beam is modulated by a video signal to display information on the CRT face. Typically, for the display of information from a data processing system the CRT beam is modulated by a digital signal which may only provide for "on" and "off" states or may provide for a limited number of other attributes such as a limited number of colors, bolded operation, or blinking operation. (those familiar with the television art will recognize the similarity between a raster display as described herein and a television raster display, though typically, a display used with a data processing system will not provide for an interlaced raster or for a continuously variable analog video input signal, as is provided in a television raster.)

Raster displays have heretofore been most useful for the display of patterns of limited numbers of predetermined signals, (e.g., text). The symbol patterns, (e.g., letters) could be stored in memory and scanned to generate a video signal in synchronism with the raster display. Further, since raster displays are less expensive to build and place less the computational burden on a processing unit, heretofore raster displays have been used for the display of graphic information by a technique known as "bit-mapping".

A schematic block diagram of a typical apparatus useful for display of bit-mapped information is shown in FIG. 1. A processor (not shown) loads data over data bus 30 into memory 10 in accordance with addresses on address and control bus 20. The processor establishes a sequence of data words in memory 10 corresponding to a "bit-map" of the display raster. That is, each bit in sequence corresponds to a "on-off" signal for a particular picture element to be displayed.

Once a bit-map is stored in memory 10 the processor issues an I/O instruction to control 40 which then sequentially unloads the data words in memory 10 to serializer 50, which outputs a serial bit stream of data to the CRT video input. Control 40 contains logic which allows it to read data from memory 10 in synchronism with the raster display and control 40 further provides horizontal synchronization signals for each line and vertical synchronization signals for each frame to maintain the raster in synchronism with the bit stream being output from serializer 50. The I/O instructions issued by the processor may be a simple initialization command where the bit-map is always stored in the same memory locations or may define a starting memory location. Access to memory 10 for both the processor and control 40 is through contention logic 60 so that the processor and the control may access memory 10 concurrently.

Apparatus such as that shown in FIG. 1 has proved useful, especially in applications where the simultaneous display of graphics and textual information was desired. However, such apparatus still presented certain problems. In particular when a display was to be changed it was necessary to extensively rework the bit-map stored in memory 10. The simple insertion of a few lines into the bit-map might require that the entire bit-map be rewritten.

In considering this problem applicant noted a heretofore unobserved analogy between the problem of controlling a bit-map display and problems in programming and text processing. All three, applicant realized, could be viewed as involving manipulation of ordered sets of symbols. In both programming and text processing strings of symbols, i.e., program code or text symbols, were linked by pointers. That is, each string of symbols was followed by data which defined the initial address of the next string. Thus, by modification of these pointers strings of symbols could be linked or unlinked.

Thus, considering the above background, it is an object of the subject invention to provide a method and apparatus wherein the data processing required to alter a CRT raster display is minimized.

It is another object of the subject invention to minimize the memory required to store and reorganize a bit-mapped display.

It is still another object of the subject invention to provide an apparatus wherein the memory used to store a bit-map may be shared concurrently by a processor and a controller. It is still another object of the subject invention to provide a method and apparatus which provide output signals in such a form that the method and apparatus may be used by standard CRT display without modification.

BRIEF SUMMARY OF THE INVENTION

The disadvantages of the prior art are overcome and the above objects are achieved in accordance with the subject invention by means of an apparatus for controlling a bit-mapped CRT display raster which includes a buffer memory for storing data, the stored data further including data constituting a picture element by picture element mapping of the information to be displayed, the mapping data consisting of groups of sequential words, each of the groups constituting a picture element by picture element mapping of a single scan line and the data further including pointers associated with the groups; each of the pointers indicating the starting address of the group associated with the next scan line, and means responsive to the pointers for outputting the mapping data as a serial bit stream with each group being synchronized with its associated scan line so that the mapping data is displayed in said display raster.

In another embodiment the apparatus of the subject invention includes a buffer memory and a processor operatively associated with the buffer memory, the processor storing data in the buffer memory, including data constituting a picture element by picture element map of the information to be displayed, the mapping data consisting of groups of sequential data words, each of said groups constituting a picture element by picture element mapping of a single scan line of the raster and the data further including pointers associated with said groups; each pointer indicating the initial address of the group associated with the next scan line, and the apparatus of this embodiment further including circuitry responsive to said pointers for outputting the mapping data as a serial bit stream; each of the groups of mapping data being synchronized with its associated scan line. The synchronized bit stream may be used as a video input signal to a CRT.

The above apparatus may be used in accordance with the method of the subject invention by storing sequential groups of data words defining a bit-map of associated scan lines in a buffer memory, storing pointers associated with the groups in the buffer memory the pointer defining the initial address of the next group, sequentially outputting and serializing the first group synchronously with the first scan line, determining the initial address of the next group from the associated pointer, sequentially outputting and serializing the next group synchronously with the next scan line, repeating the previously two steps until the last group is output and returning to output the first group again synchronously with the first scan line.

Thus, it may be seen that the subject invention advantageously provides a method and apparatus whereby the time required to alter a bit-mapped display is significantly reduced.

It is a further advantage of the subject invention that it achieves the above objects while requiring only relatively minor changes to the circuitry of the display control and only relatively minor changes in programming.

Other objects and advantages of the subject invention will be obvious to those skilled in the art from a consideration of the detailed description set forth below and the attached drawings.

DETAILED DESCRIPTION OF PREFERRED EMBODIMENTS OF THE SUBJECT INVENTION

Figure 1:
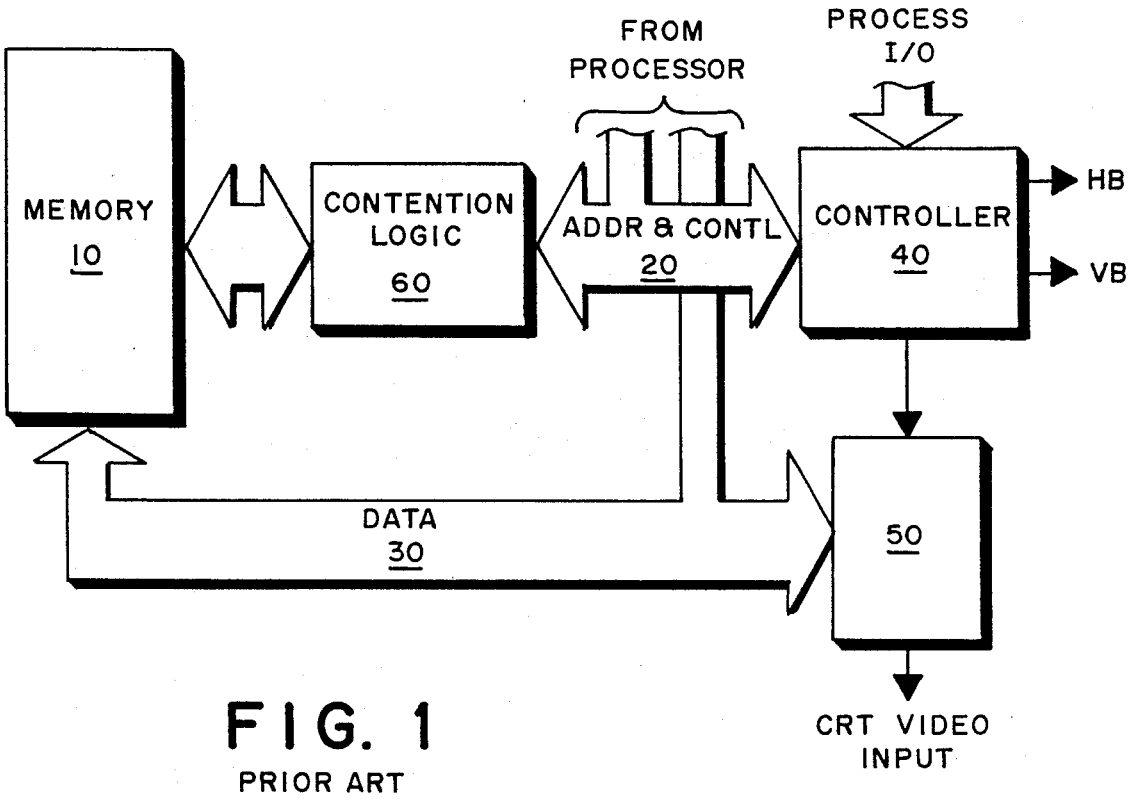
FIG. 1 PRIOR ART
FIG. 1 is a schematic block diagram of a piror art apparatus for controlling a CRT raster display.
Figure 2:
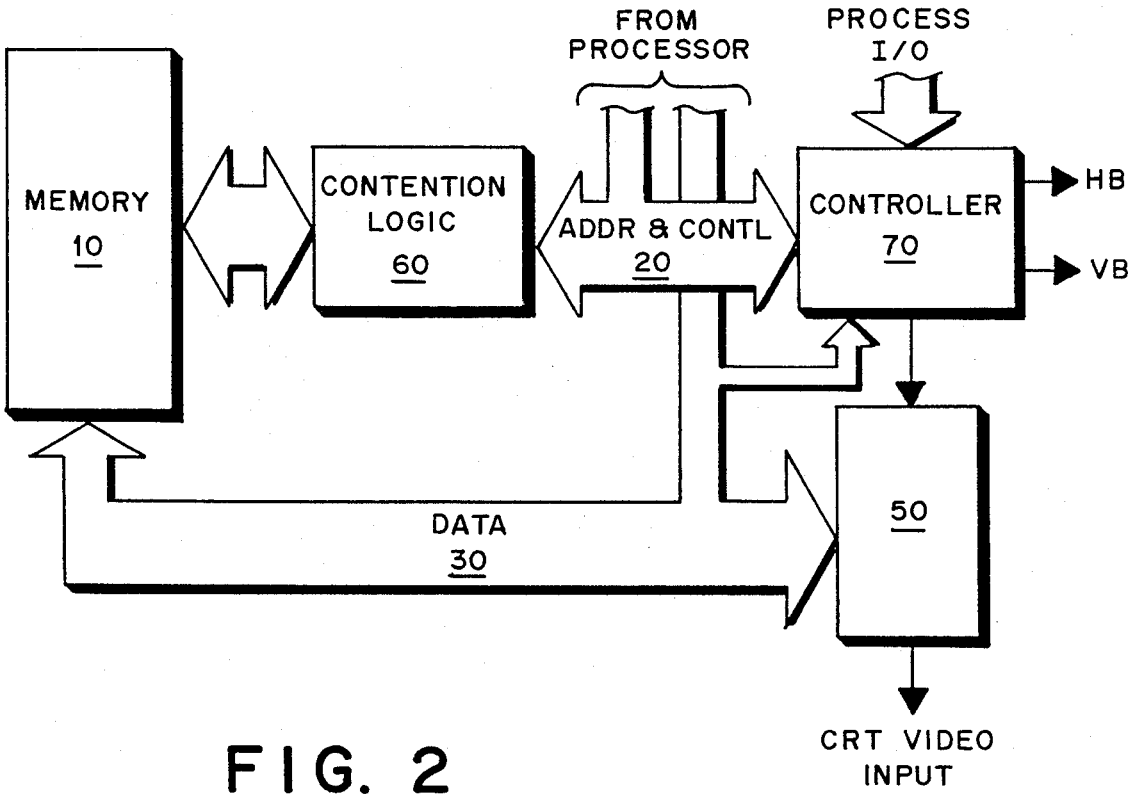
FIG. 2 is a schematic block diagram of an apparatus in accordance with the subject invention.

Referring to FIG. 2, a schematic block diagram of an apparatus in accordance with the subject invention is shown. It may be noted that the apparatus of FIG. 2 differs from that of the prior art, as shown in FIG. 1, in that controller 70, which accesses data bus 30 and has been substituted for controller 40. Because controller 70 accesses data bus 30, pointers, as described below, may be read by controller 70 allowing controller 70 to "link" groups of data words representing sequential scan lines in a manner which will be described more fully below. Also, it will be noted that the inputs and outputs of the apparatus of FIG. 2 remain unchanged from those of the apparatus of FIG. 4, thus, ensuring that the apparatus of the subject invention may be readily substituted for prior art apparatus.

Figure 3:
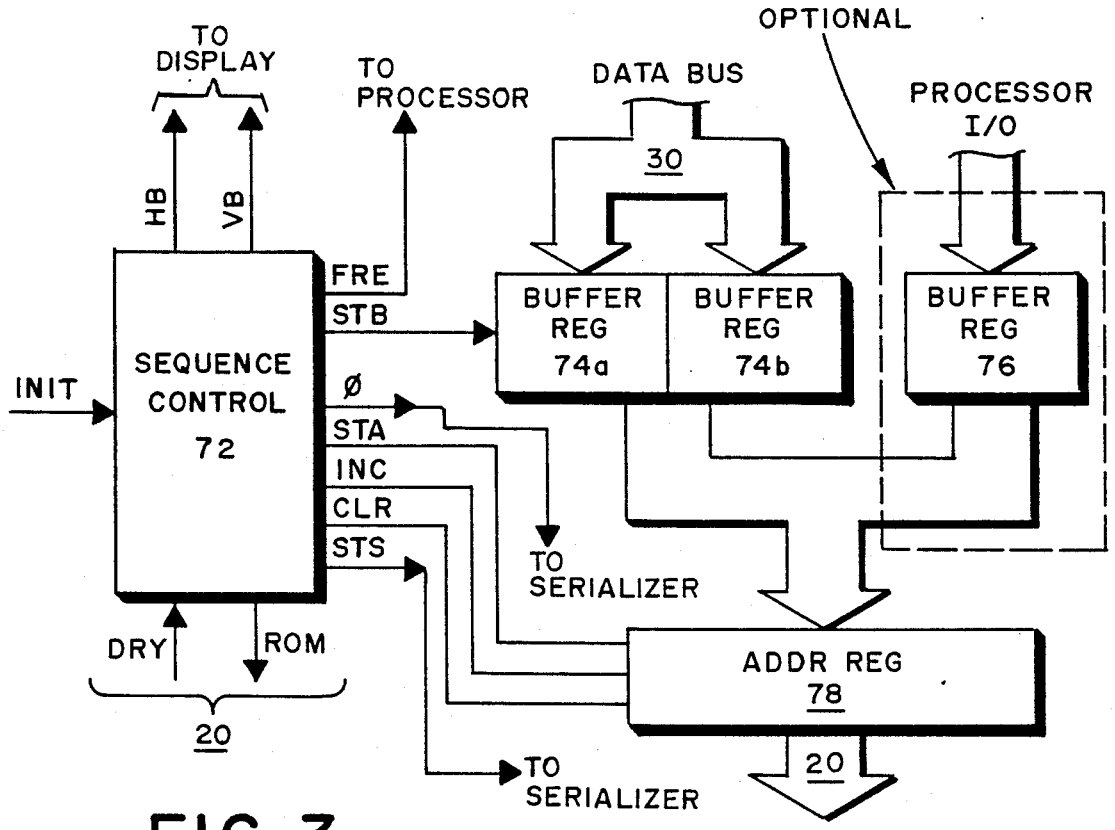
FIGS. 3 and 3*a* are a schematic block diagram of control circuitry for the apparatus of FIG. 2.
Figure 3A:
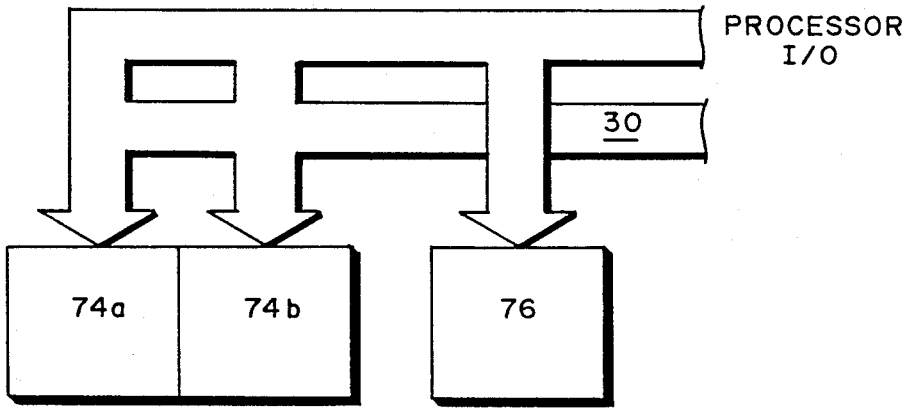

FIGS. 3 and 3*a* show a more detailed schematic block diagram of controller 70 of FIG. 2. Considered in conjunction with FIGS. 4 and 4*a*, these figures show the operation of the apparatus of the subject invention.

Prior to time $t_0$ the processor (not shown) issues an initialization signal on line INIT. In response sequence control 72 issues a clear signal on line CLR to address register 78. At time $t_0$ control 72 issues two memory read signals on line RDM and the memory responds with two data ready signals on line DRY. Between the RDM signals address register 78 is incremented by a signal on line INC and as each DRY signal is received the data is sequentially strobed from data bus 30 into buffer registers 74*a* and 74*b* by a signal on line STB. Sequence control 72 then transfers data from register 74*a* and 74*b* into address register 78 by generating a signal on line STA; thus reading the pointer for the initial address of the initial scan line group from memory locations 0 and 1.

Optionally the range of addressable memory locations may be extended by the addition of buffer register 76 which is loaded by a processor I/O instruction coincidently with the INIT instruction, providing an additional 8 bits of memory address range.

Figure 4:
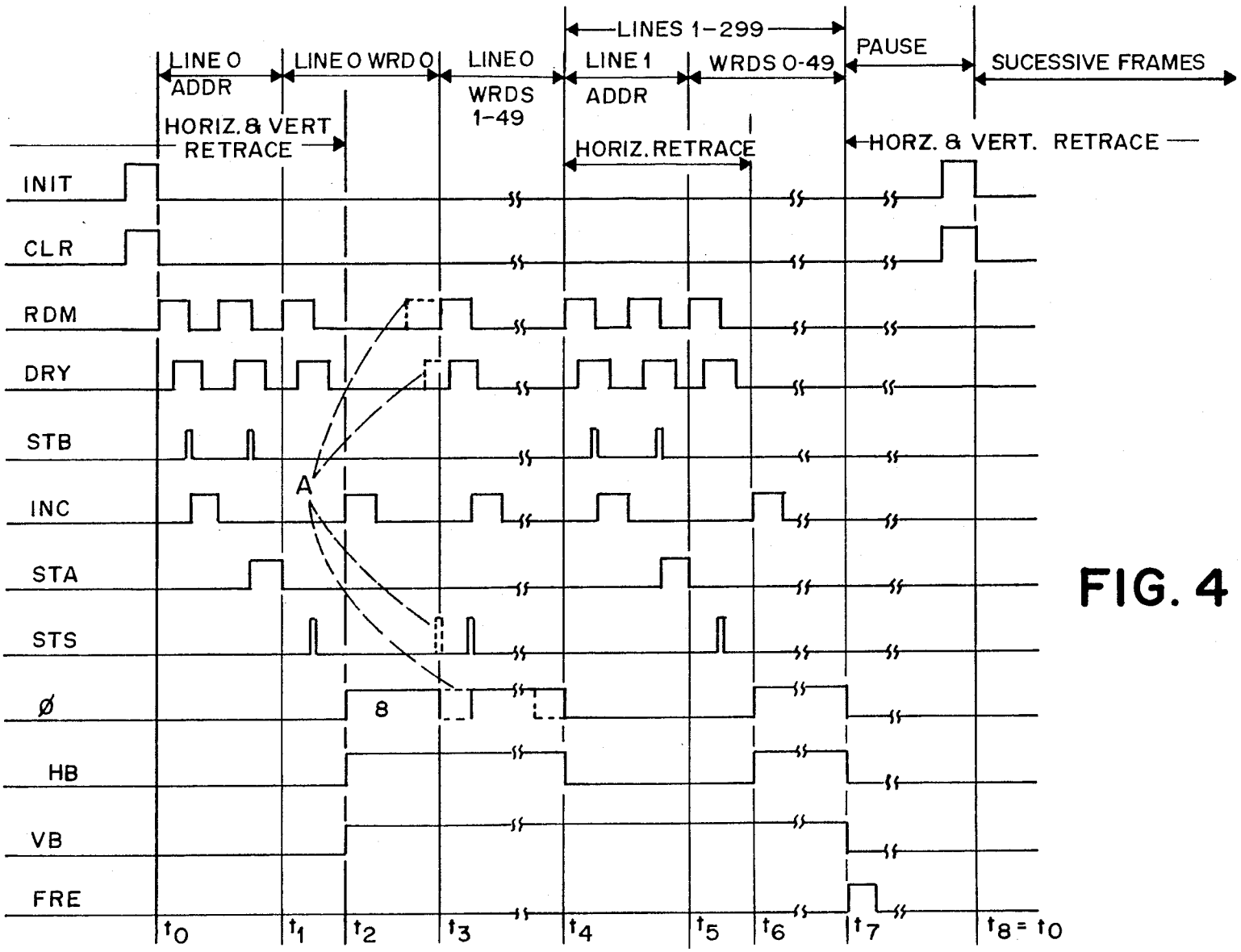
FIGS. 4 and 4*a* are a sequence diagram for the operation of the control logic of FIG. 3.
Figure 4A:
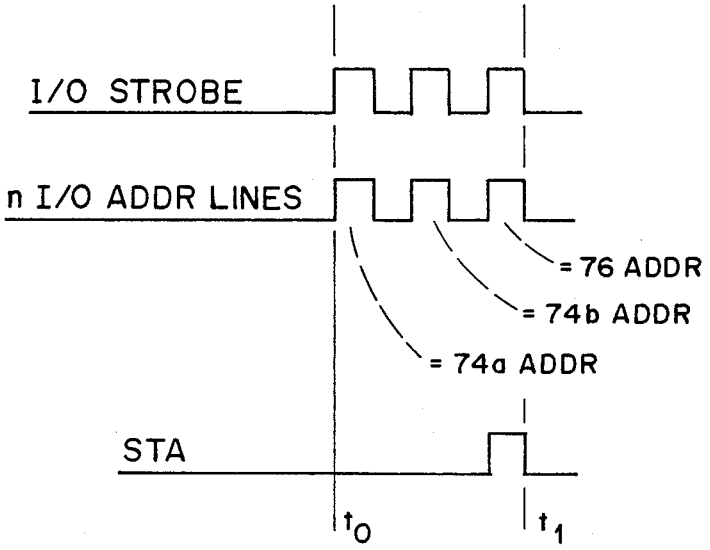

In another preferred embodiment the initial pointer need not be stored in memory but may be transferred by a sequence of I/O operations to registers 74*a* and *b* and 76 as shown in FIGS. 3*a* and 4*a*.

No matter which technique is used, however, to establish the initial address of the initial scan line group; at time $t_1$ sequence control 72 issues another RDM signal and memory 10 responds with a DRY signal Sequence controller 72 then issues a strobe signal on line STS to serializer 50 loading the first word of the first scan line group into serializer 50. Sequence control 72 then issues a series of 8 clock pulses on line CLK to serializer 50 shifting the 8 bits of data out in a serial form to the video input of the CRT. While the data word is being output by serializer 50 sequence control 72 issues a signal on line INK to address register 78 to increment to the next word in the scan line group.

(For purposes of this illustrative description a non-interlaced scan of 300 lines, with 400 picture elements per line and a frame repetition rate of 30 frames per second is assumed. Allowing time for scan retrace, both vertical and horizontal, this yields a bit rate of approximately 4 megabits per second (and clock rate of approximately 4 megahertz). Also, for simplicity of description, the bit map will consist of one bit per picture element, though those skilled in the art will recognize that additional bits may be added in parallel memory planes to provide more attributes per picture element.)

Thus, at time $t_3$ in FIG. 4 sequence control 72 repeats the cycle shown from time $t_1$ to $t_3$ for the next word in the scan line group. From time $t_3$ to time $t_4$ this cycle is repeated for words one through 49 of the initial scan line group. (it should be noted that though in FIG. 4 considerable separation is shown between signals on the CLK line this is for ease of illustration only. Those skilled in the art will recognize that memories having cycle times of less than 250 nano seconds are readily commercially available and that the next word may be transferred to serializer 50 within one CLK cycle so that data may be presented smoothly and without interruption. Alternatively the RDM signal maybe generated one or two CLK cycles before time $t_3$ (as shown at "A" in FIG. 4) so as to assure the availability of the data on data bus 30 at time $t_3$.)

At times $t_4$ to $t_5$ sequence control 72 repeats the cycle from $t_0$ to $t_1$. Signal address register 78 then accesses the next two data words at the end of the initial scan line group and the information is strobed by the STB signal into buffer registers 74*a* and 74*b* from data bus 20 and then transferred to address register 78.

From times $t_5$ to $t_7$ words 0–49 of line 1 are output and serialized by repeating the cycle as described above.

The cycle shown from times $t_3$ to $t_6$ is repeated for lines 1–299 to display a full raster. The time from time $t_7$ to $t_8$ is a pause to allow for vertical retrace.

Horizontal blanking signal HB and vertical blanking signal VB are generated for the CRT at the appropriate times to blank the video signal for retrace and to maintain synchronization with the data bit stream from serializer 50 by sequence control 72 as shown in FIG. 4.

At time $t_7$ sequence control 72 generates a signal on line FRE to the processor (not shown) to indicate that a frame is complete. After receiving the FRE signal the processor (not shown) may generate an INIT signal or may extend the pause to modify the bit-map as described below.

Returning to FIG. 2, contention resolution logic 60 preferably allows the processor to access memory 10 on a "cycle-scaling" basis. That is, the processor (not shown) may access memory 10 for one cycle whenever controller 70 is not accessing memory 10. If the memory cycle time is sufficiently short with respect to the access cycle of controller 70 such cycle stealing will not visibly effect the display. Alternatively, as described above, sequence controller 70 may generate the RDM signal one or two CLK cycles early as shown at "A" in FIG. 4 to prevent interference with its access to memory 10 and assure a smooth bit stream from serializer 50. (such "cycle-stealing" control of memory access is well known to those skilled in the art and need not be described further here for an understanding of the subject invention.)

Figure 5B:
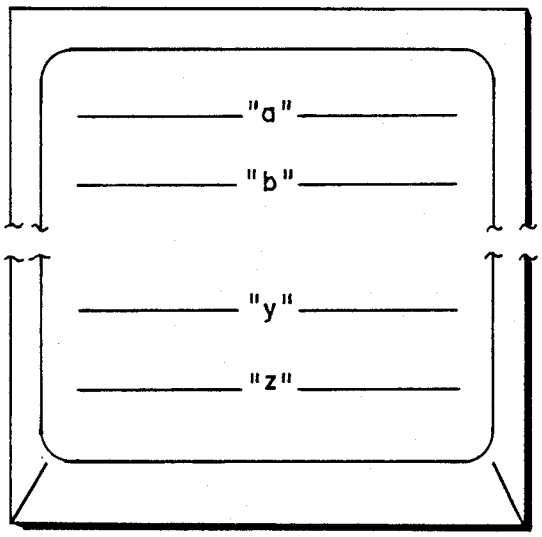
FIGS. 5*a* and 5*b* are a representation of the storage and display of a raster in accordance with the subject invention.
Figure 5A:
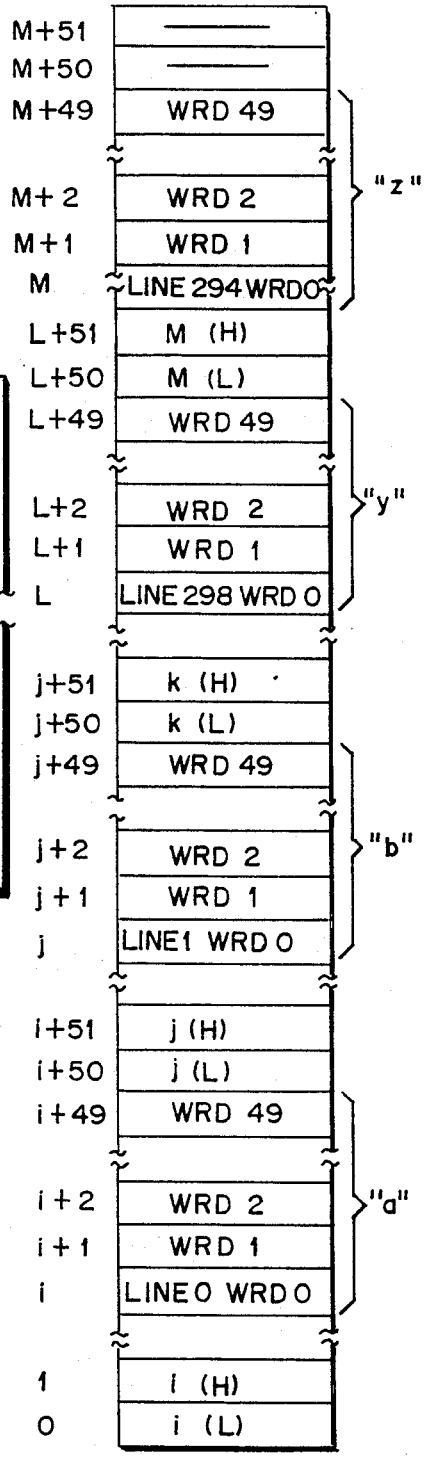

In FIG. 5*a* and 5*b* a typical raster is shown as stored in memory 10 and, in a highly stylized fashion, as displayed on the CRT. The first scan line group is stored in memory locations i through i+49 and is represented in FIG. 5*b* by "a". Locations i+50 and i+51 contain the low order and high order bits of a pointer to location j. The second scan line group is stored in memory locations j through j+49, and is shown in FIG. 5*b* as the scan line represented by "b". Locations j+50 and j+51 contain the low order and high order bits respectively of a pointer to location k which stores the first word of the scan line group for the third scan line (not shown). Other locations not shown store the other scan line groups between scan lines 2 and 297 and scan line group 298 is stored in locations l through l+49 and is shown in FIG. 5*b* as the scan line represented by "y". Locations l+50 and l+51 again contain the pointer to location m where scan line group 299, the last scan line begins. Note that locations m+50 and m+51 are reserved but are not defined since the sequence control is re-initialized for each frame.

The initial pointer for location i is shown in FIG. 5*a* as being stored in memory locations 0 and 1. However, as described above the initial pointer may be either wholly or partially transferred to controller 70 through I/O operations from the processor.

Figure 6B:
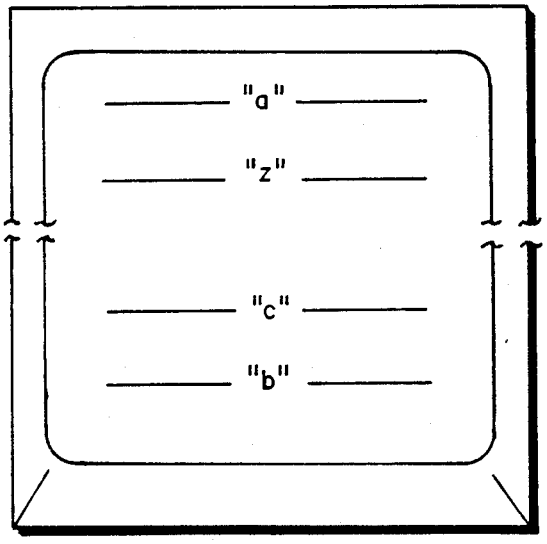
FIGS. 6*a* and 6*b* are a representation of the storage and display of a raster which is modified by "wrapping-around" one line.
Figure 6A:
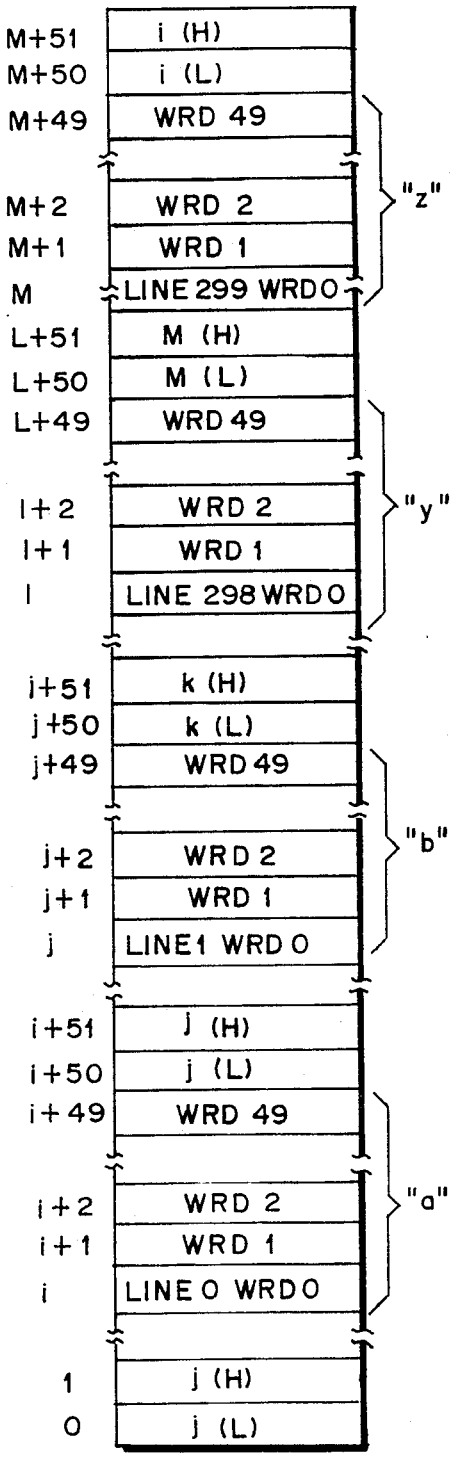

FIG. 6 shows a representation of the storage and display of the raster display of FIG. 5 which has been modified by a "wrap-around" operation. The processor has modified the pointer in location 0 and 1 to point to the second scan line, represented by "b" in FIG. 6*b* and modified the pointer in locations m+50 and m+51 to point to location i. The resultant display is seen in FIG. 6*b* wherein all display lines are moved upward one line and the initial line represented by "a" is "wrapped-around" to the bottom of the display. Thus, it may be seen that the display may be readily be altered simply by changing the correlation between the groups of data words and the scan lines by a simple adjustment of the pointers.

Figure 7B:
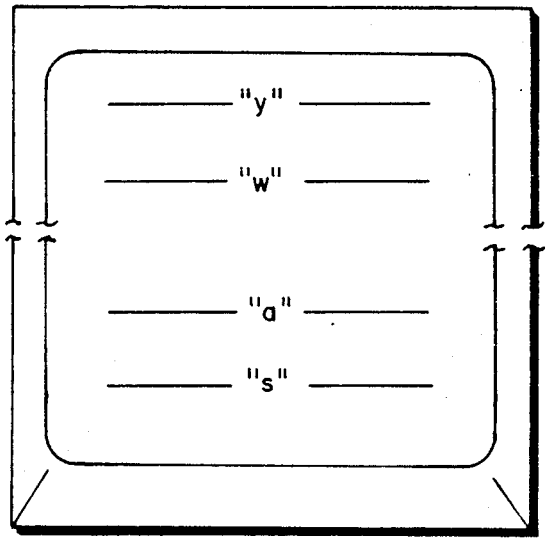
FIGS. 7*a* and 7*b* are a representation of the storage and display of a raster which is scrolled down one line in accordance with the subject invention.
Figure 7A:
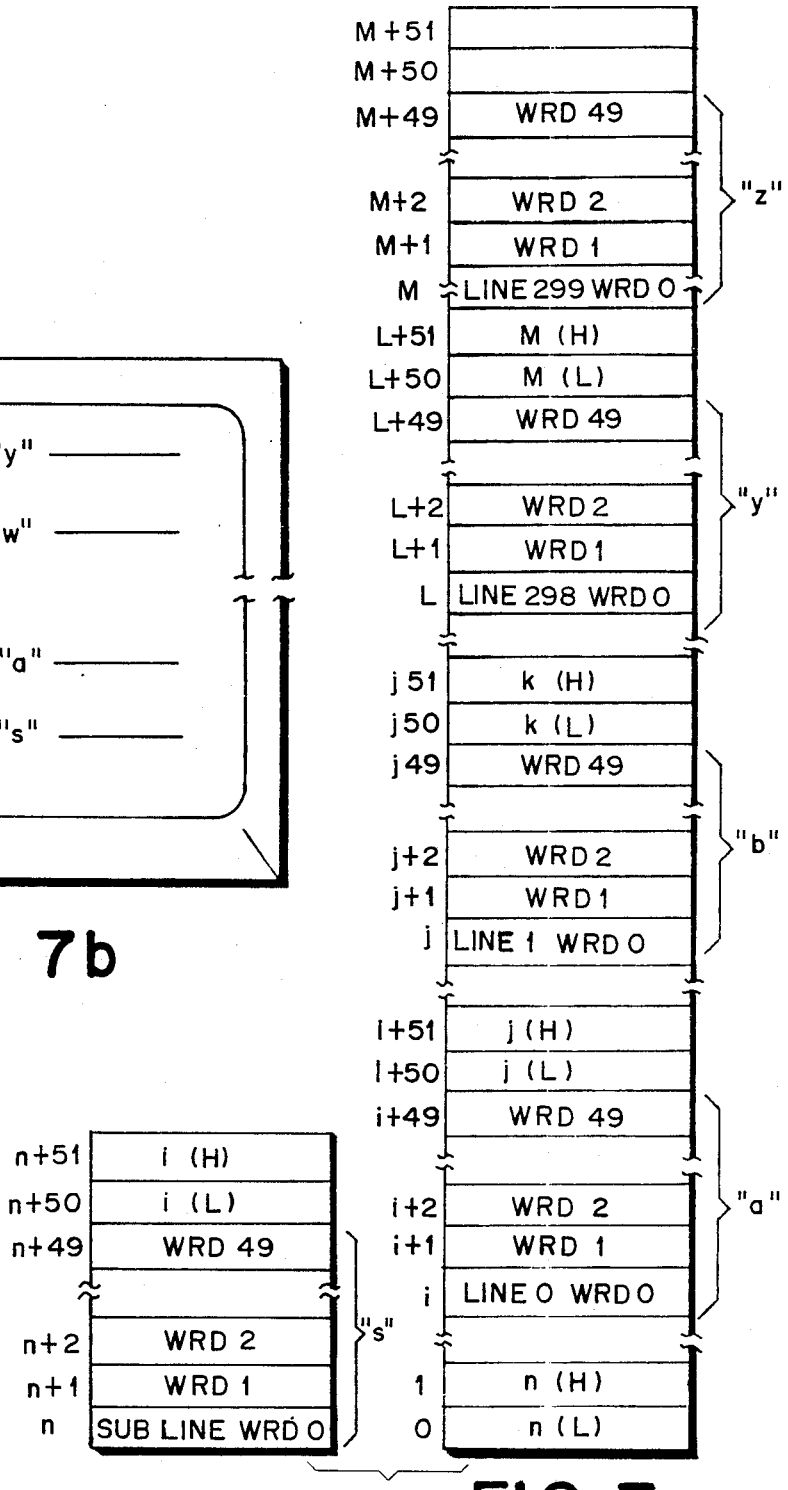

FIG. 7 shows a representation of the storage and display of the raster display of FIG. 5 which has been scrolled down one line. The processor has stored a new line in locations n through n+49 with a pointer in locations n+50 and n+51 pointing to the original initial line "a" in location i. To scroll the display up one scan line the processor rewrites the initial pointer in locations 0 and 1 to point to location n. Note that the last line displayed is now stored in locations l through l+49 and that the pointer in locations l+50 and l+51 still points to location m but is no longer used during the display.

Figure 8B:
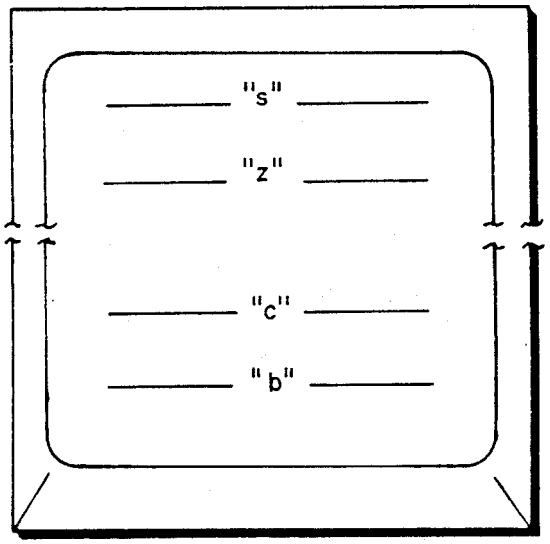
FIGS. 8*a* and 8*b* are a representation of a raster which is scrolled up one line in accordance with the subject invention.
Figure 8A:
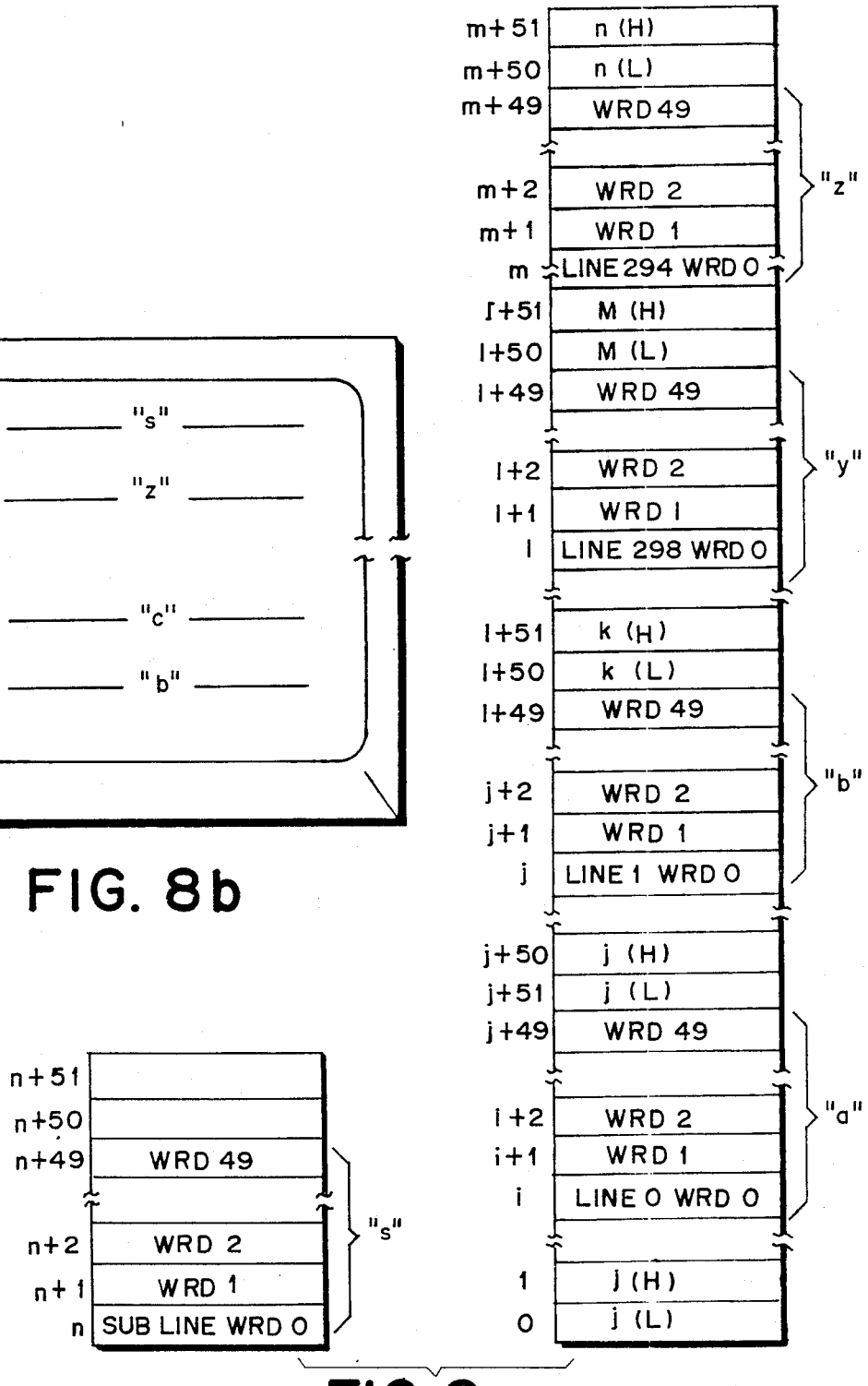

FIG. 8 shows a representation of the storage and display of the raster display of FIG. 5 which has been scrolled up one line. The processor stored a new line in locations n through n+49 and reserves locations n+50 and n+51 for a pointer. To scroll the display up one line the processor rewrites the initial pointer in locations 0 and 1 to point to location j and stores a pointer to location n in the reserved pointer at locations m+50 and m+51. As seen in FIG. 8*b* this results in the shifting up of each line in the display and the substitution of line "s" for the bottom line of the display.

Figure 9B:
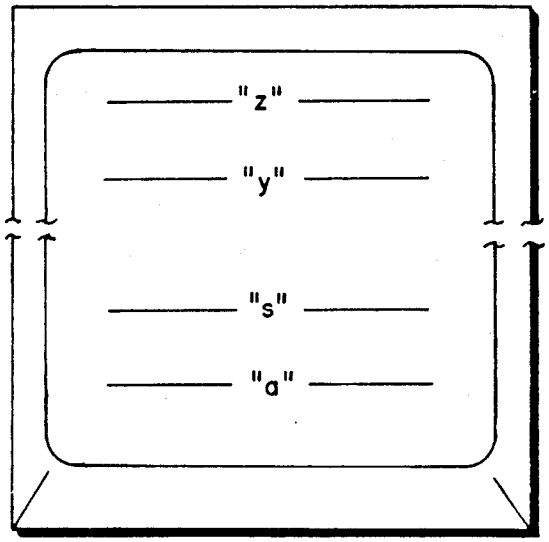
FIGS. 9*a* and 9*b* are a representation of the storage and display of a raster wherein a substitute line is inserted in accordance with the subject invention.
Figure 9A:
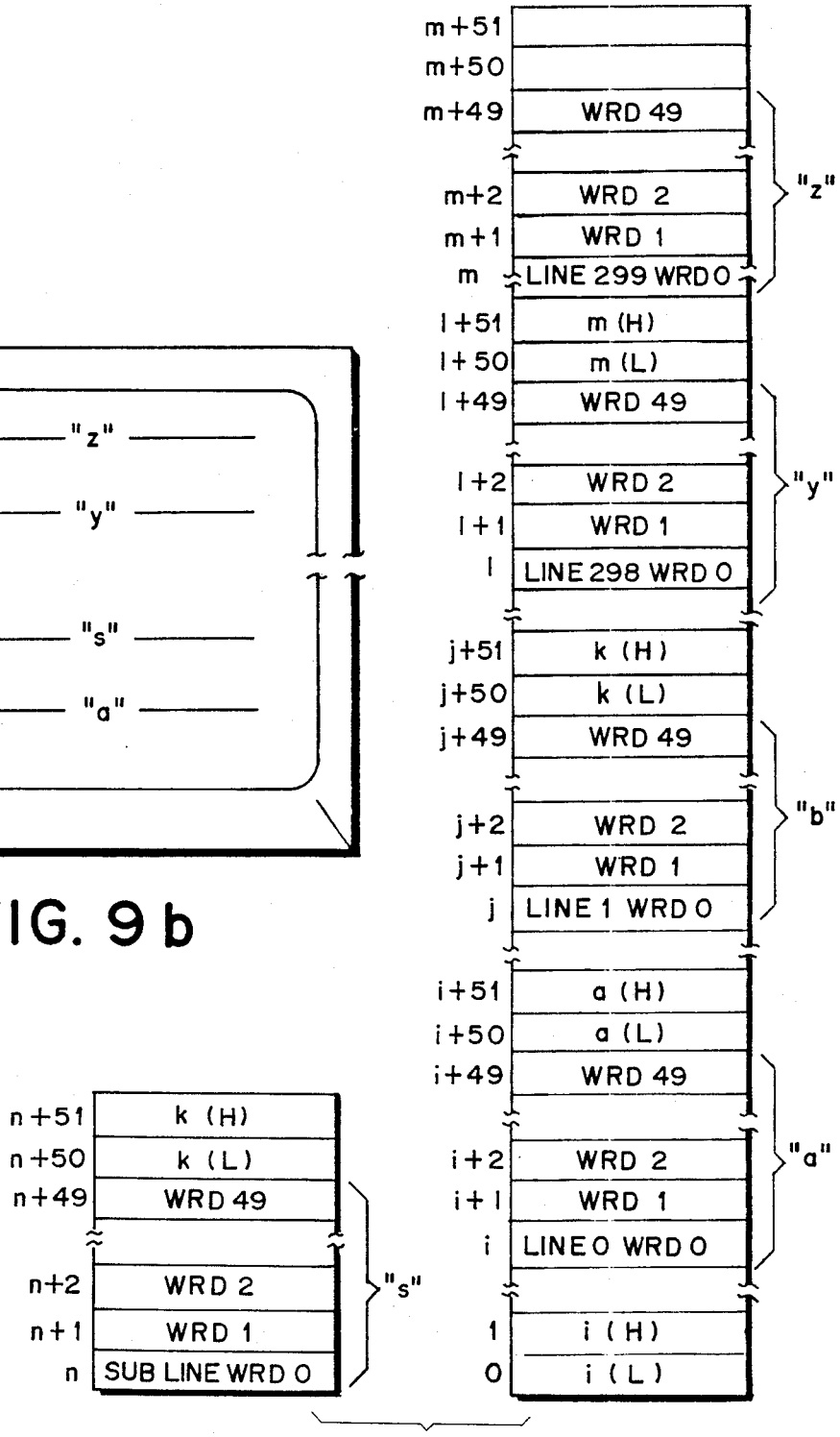

FIG. 9 shows a representation of the storage in display of the raster display of FIG. 5 where a substitution has been made. Again the processor stores a new line in location n+49 and stores a pointer to location k in locations n+50 and n+51. To substitute the line stored in location n through n+49 for the line represented by "b" the processor rewrites the pointer in location i+50 and location i+51 to point to location n. The resulting substitution is seen in FIG. 9*b* where the line represented by "s" is substituted for the line represented by "b".

Those skilled in the art will recognize that the operation shown in FIGS. 6–9 need not, of course, be limited to operations on single scan lines. Simply by assembling appropriately linked groups the display may be scrolled by an arbitrary number of lines or an arbitrary number of lines may be substituted into a display. Further, merely by rewriting the pointers appropriately existing lines may be rearranged in a completely arbitrary manner. Further it should be noted that while new groups may be stored and linked in memory 10 at any time during the display cycle it is preferable that the active pointers be modified only during the pause at time $t_7$ time and before the processor re-initializes control 70 to prevent the accidental modification of a pointer while it is being used, which might result in a display of "garbage" on the CRT. To provide time for modifying the active the processor may extend the pause and delay re-initialization for the next frame until the pointers are appropriately linked for the display.

The above description of preferred embodiments and the attached drawings have been provided by way of illustration only and numerous other embodiments of the subject invention will be apparent to those skilled in the art from the examples and illustrations provided. Thus, the limitations on the claimed invention are to be found only in the claims set forth below.

What is claimed is:

1. An apparatus for controlling a bit-mapped CRT display raster comprising:

(a) a buffer memory for storing data, said stored data including mapping data constituting a picture element by picture element mapping of the information to be displayed, said mapping data consisting of groups of data words stored in sequential memory locations, each of said groups constituting a picture element by picture element mapping of one scan line of said raster, and said stored data further including pointers associated with said groups of data, each of said pointers indicating the starting address of the group associated with the next sequential scan line; and, (b) output means, operatively associated with said memory and responsive to said pointers, for outputting said mapping data as a serial bit stream, each of said groups being synchronized with its associated scan line, whereby said mapping data is displayed in said display raster.

2. An apparatus as described in claim 1 wherein said output means further comprises:

(a) serializer means for receiving data words from said buffer memory and for serially transmitting said data words to the video control circuitry of said CRT;

(b) control means for sequentially accessing and transmitting to said serializer means the data words of each of said groups, said control means being responsive to said pointers associated with said groups for selecting the next group to be transmitted and said control means operating synchronously with said display raster so that each of said groups is transmitted and serialized synchronously with its associated scan line;

(c) means for initializing said control means with the starting address of the group associated with the first scan line.

3. An apparatus as described in claim 1 wherein said output means further comprises means for generating horizontal and vertical blanking signals and said CRT is responsive to said signals to start horizontal and vertical scans.

4. An apparatus as described in claim 2 wherein said output means further comprises means for generating horizontal and vertical blanking signals and said CRT is responsive to said signals to start horizontal and vertical scans.

5. An apparatus as described in claim 1 wherein said output means further comprises a clock, said output means being responsive to said clock to serialize said data uniformly across said scan lines.

6. An apparatus as described in claim 2 wherein said output means further comprises a clock, said serializer means being responsive to said clock to serialize said data uniformly across said scan lines.

7. An apparatus as described in claim 4 wherein said output means further comprises a clock, said serializer means being responsive to said clock to serialize said data uniformly across said scan lines.

8. An apparatus as described in claim 1 wherein said pointers consist of a predetermined number of data words stored in memory locations subsequent to and sequential with each pointers associated group and wherein said output means further comprises a buffer register, means for transferring data from said buffer memory to said buffer register, and an address register operatively associated with said buffer memory for defining the address of a data word to be accessed, said output means sequentially incrementing said address register to output one of said groups of data to said serializer means, said output means further incrementing said address register after outputting said one of data groups to said serializer means to transfer said predetermined number of data words to said buffer register, said output means then transferring data from said buffer register to said address register, whereby said address contains the address of the first word of the group associated with the next sequential scan line.

9. An apparatus as described in claim 2 wherein said output means further comprises a buffer register, means for transferring data from said buffer memory to said buffer register, and an address register operatively associated with said buffer memory for defining the address of a data word to accessed, said output means sequentially incrementing said address register to output one of said groups of data words to said serializer means, said output means further incrementing said address register after outputting said one of said groups to said serializer means transfer said predetermined number of data words to said buffer register, said output means then transferring data from said buffer register to said address register, whereby said address contains the address of the first word of the group associated with the next sequential scan line.

10. An apparatus as described in claim 4 wherein said output means further comprises a buffer register, means for transferring data from said buffer memory to said buffer register, and an address register operatively associated with said buffer memory for defining the address of a data word to be accessed, said output means sequentially incrementing said address register to output one of said groups of data words to said serializer means, said output means further incrementing said address register after outputting said said one of said groups to said serializer means transfer said predetermined number of data words to said buffer register, said output means then transferring data from said buffer register to said address register, whereby said address contains the address of the first word of the group associated with the next sequential scan line.

11. An apparatus as described in claim 9 where in said initializing means further comprises means for receiving signals from an external source, said signals comprising data defining the initial address of the initial group.

12. An apparatus as described in claim 9 wherein said output means is responsive to an external initialization signal to read a predetermined number of data words from predetermined locations in said buffer memory, said data words at least partially defining the initial address of the initial group.

13. An apparatus as described in claim 12 wherein said output means further comprises means for receiving signals from an external source, said signals comprising data which, combined with the data from said predetermined locations, defines the initial address of the initial group.

14. An apparatus as defined in claim 11 further comprising means responsive to said external signals for generating a vertical synchronization signal for starting a new frame of said raster.

15. An apparatus as defined in claim 12 further comprising means responsive to said external signals for generating a vertical synchronization signal for starting a new frame of said raster.

16. An apparatus as defined in claim 13 further comprising means responsive to said external signals for generating a vertical synchronization signal for starting a new frame of said raster.

17. An apparatus for controlling a bit-mapped CRT display raster comprising:

(a) a buffer memory (b) a processor operatively associated with said buffer memory, said processor storing in said buffer memory data including mapping data constituting a picture element by picture element mapping of the information to be displayed, said mapping data consisting of groups of data words stored in sequential memory locations, each of said groups constituting a picture element by picture element mapping of one scan line of said raster, and said data further including pointers associated with said groups, each of said pointers indicating the initial address of the group associated with the next sequential scan line; and, (c) means responsive to said pointers for outputting said mapping data as a serial bit stream, each of said groups being synchronized with its associated scan line, whereby said mapping data may be used as a video input signal to said CRT.

18. An apparatus as described in claim 17 wherein said output means further comprises:

(a) serializer means for receiving data words from said buffer memory and for serially transmitting said data words to the video control circuitry of said CRT;

(b) control means for sequentially accessing and transmitting to said serializer means the data words of each of said groups, said control means being responsive to said pointers associated with said groups for selecting the next group to be transmitted and said control means operating synchronously with said display raster so that each of said groups is transmitted and serialized synchronously with its associated scan line;

(c) means for initializing said control means with the starting address of the group associated with the first scan line.

19. An apparatus as described in claim 18 wherein said output means further comprises a buffer register, means for transferring data from said buffer memory to said buffer register, and an address register operatively associated with said buffer memory for defining the address of a data word to accessed, said output means sequentially incrementing said address register to output one of said groups of data words to said serializer means, said output means further incrementing said address register after outputting said one of said groups to said serializer means to transfer said predetermined number of data words to said buffer register, said output means then transferring data from said buffer register to said address register, whereby said address register contains the address of the first word of the group associated with the next sequential scan line.

20. An apparatus as described in claim 17 further comprising conflict resolution means for resolving conflicts between said processor and said output means for access to said buffer memory, so that said processor may store new groups of data words to be displayed, and associated pointers, in said buffer memory concurrently with the display of previously stored groups.

21. An apparatus as described in claim 20 wherein further said processor may modify previously stored pointers.

22. An apparatus as described in claim 21 wherein said pointers are modified to alter the correspondence between said groups and said scan lines.

23. An apparatus as described in claim 21 wherein said newly stored groups may be displayed by modifying said previously stored pointers to link said newly stored groups and unlink a corresponding number of previously stored groups.

24. An apparatus as described in claim 21 wherein said pointers are modified only between frames of said raster display.

25. A method of displaying bit-mapped data on a raster display comprising the steps of:

(a) storing sequential groups of data words defining bit-maps of associated scan lines in a buffer memory;

(b) storing pointers associated with said groups in said buffer memory, said pointers defining the initial address of the group associated with the next sequential scan line;

(c) sequentially outputting and serializing the initial group synchronously with the initial scan line;

(d) determining the initial address of the next group from said associated pointer;

(e) sequentially outputting and serializing said next group synchronously with said next sequential scan line;

(f) repeating steps (d) and (e) until the last group is output; and (g) returning to step (c).

26. The method of claim 25 wherein the display is modified by modifying the correspondence between said groups and said scan lines by modifying said pointers.

27. The method of claim 25 wherein the display may be modified by modifying said associated pointers to link new groups and associated pointers and unlink a corresponding number of previously stored groups and pointers.

28. The method of claim 25 wherein the initial address of the initial group is obtained from an external signal.

29. The method of claim 25 wherein at least a portion of the initial address of the initial group is stored in pre-selected locations in said buffer memory.

30. The method of claim 29 wherein the remaining portion of said initial address is obtained from an external signal.

* * * * *